US005351842A

United States Patent [19]

Remmers

[11] Patent Number: 5,351,842

[45] Date of Patent: Oct. 4, 1994

[54] SHELF AND SUPPORT ASSEMBLY

[75] Inventor: Lee E. Remmers, Ocala, Fla.

[73] Assignee: Vermont American, Louisville, Ky.

[21] Appl. No.: 123,300

[22] Filed: Sep. 17, 1993

[51] Int. Cl.[5] ..... A47F 5/00

[52] U.S. Cl. ..... 211/90; 211/106; 211/123; 108/29; 108/152

[58] Field of Search ..... 211/90, 106, 187, 186, 211/123; 248/235, 249; 108/152, 111, 29

[56] References Cited

U.S. PATENT DOCUMENTS

| | | | |
|---|---|---|---|
| 2,827,555 | 3/1958 | Woolley | 211/90 X |
| 3,220,363 | 11/1965 | Gingher | 108/29 X |
| 3,321,089 | 5/1967 | Krikorian | 211/134 |
| 3,565,020 | 2/1971 | Schier et al. | 108/29 X |
| 3,702,591 | 11/1972 | Banse | 211/90 X |
| 3,865,336 | 2/1975 | Robertson | 211/90 X |
| 4,407,476 | 10/1983 | Bohannan | 211/90 X |
| 4,603,781 | 8/1986 | Ryan | 211/90 |
| 4,624,376 | 11/1986 | Bertram | 211/187 |
| 4,658,968 | 4/1987 | Mastrodicasa | 248/250 X |
| 4,753,405 | 6/1988 | Camilleri | 248/235 |

*Primary Examiner*—Robert W. Gibson, Jr.
*Attorney, Agent, or Firm*—Middleton & Reutlinger

[57] ABSTRACT

The shelf and support assembly of the present invention utilizes a unique curved-front, wall mounted, ventilated shelving system using one type of bracket with one type of shelf and an optional hang rod assembly to make shelving systems for a linen type shelf system and a wardrobe shelf system. The shelf is removably mounted to a pair of shelf support brackets which support the shelf in a horizontal plane when the support brackets are secured to an associated wall. The shelving system is unique in that the shelf includes a plurality of transverse members which are removably and securely snapped into place via a friction fit within a plurality of transverse slots formed into the top surface of the brackets. No additional hardware is needed to hold the shelf in position. A hang rod adapter is formed having a sleeve which slidingly supports a hang rod. The support bracket is formed having a longitudinal groove for cooperative engagement with the hang rod adaptor to support a rod and form a wardrobe shelf assembly. The shelf and rod shelf system is assembled by simply placing the hang rod adapter insert into the front of each bracket. The shelf is then snapped into place in cooperative engagement with the support brackets, holding the hang rod adapter within the support bracket.

39 Claims, 4 Drawing Sheets

SHELF AND SUPPORT ASSEMBLY

BACKGROUND OF THE INVENTION

The present invention relates to storage shelf assemblies, and more particularly to closest assemblies such as linen shelves, which are adaptable for easy and convenient installation in areas having different wall configurations.

Prior art shelf assemblies often have the problem that the shelf portion of the assembly is not at all secured to the shelf mounting brackets, thus permitting accidental movement. Unsecured shelves present safety problems when objects are placed upon the shelf without evenly distributing the weight causing damage to the shelf, objects supported thereon, and even the user.

Conventional shelving assemblies attempt to overcome this problem by securing the shelf to mounting brackets; however, considerable time and effort is needed to provide custom sized shelving and the assembly thereof. Often a shelf needs to be replaced or the entire shelving system requires moving into a different area of the same closet or other area. Thus, the brackets and shelf must be disassembled. Conventional shelves are often custom designed so that a specific length shelf must be used with a particular brackets, or the brackets must be spaced according to the structural features of a particular shelf, or the linen shelf needs a clothes rod located adjacent to or in the immediate area thereof to support hanging objects.

The present shelf and support assembly provides an inexpensive means of providing a shelving system incorporating a durable removable shelf and optional hang rod assembly which is versatile and can be used with different styles, colors, and lengths of shelving.

SUMMARY OF THE INVENTION

The shelf and support assembly of the present invention utilizes a unique curved-front wall mounted, ventilated shelving system using one type of bracket with one type of shelf and an optional hang rod assembly to make shelving systems for a linen type shelf system and a wardrobe shelf system.

A linen type shelf system comprises a shelf, shelving support bracket, and optional hang-rod. The shelving system is unique in that the shelf removably and securely snaps into place via a friction fit within recesses or slots formed into the top surface of the support brackets. No additional hardware is needed to hold the shelf in position.

The ventilated shelf of the preferred embodiment is comprised of platform members or stringers spaced apart and parallel to one another and are attached to and supported by a plurality of frame members or support rods. A first shelf frame member forms the front edge of the shelf. A second shelf frame member forms the front end of the planar portion of the shelf. The portion of the shelf comprising platform members extending from the second shelf frame member to the first front shelf frame member are curved downward to form a front curved shelf lip surface. A third interior shelf frame member extends along the longitudinal axis near the center of the shelf. A fourth shelf frame member forms is positioned at end of the planar portion of the shelf. The portion of the shelf platform members extending from the fourth frame member to the rear end shelf frame member are angled downwardly, or bent downward at an angle around the fourth support rod to form a straight rear lip shelf surface.

The shelving bracket is formed having a generally triangular shaped shelf support member extending outward perpendicular from a generally flat tapered base attached to a flat surface such as a wall. The shelf support member may be formed integrally with the base or formed separately therefrom attachable by a tongue and groove assembly. The top of the shelf support member is formed having a generally flat surface curved downward on each end defining a rail adapted for supporting the shelf. The rail surface has a plurality of recesses or transverse slots formed therein providing a first front slot to cooperatively engage the first front frame member, a second interior slot to cooperatively engage the second frame member, and a third interior slot to cooperatively engage the third central frame member. The fourth frame member positioned to rest upon the curved portion of the rail to provide a level shelf surface. The fifth rear shelf frame member cooperatively engages the fifth rear slot.

An alternate embodiment of the shelf and support assembly employs an optional hang rod assembly to form a wardrobe shelving system. Before assembling the shelf onto the brackets, a hang rod adapter is formed having a sleeve with a cylindrical bore on one end, and a "T-shaped" base insert oriented at a right angle from the bore. The shelf and support system is assembled by simply placing the hang rod adapter insert into the front "T-shaped" slot or longitudinal groove at the front of each support bracket superimposed over the front transverse slot. A hang-rod, is then placed through the bore of the hang rod adapter sleeve. The shelf is then snapped into place wherein the frame members are in cooperative engagement with the transverse slots of the support bracket, whereby the first front shelf frame member covers the hang rod adapter, thereby locking the adapter into position within the "T-shaped" slot of the support bracket providing for a wardrobe shelf system.

Accordingly, it is an object of the present invention to provide a shelving system wherein only one type of bracket and shelf is required to make two different types of shelving systems, a linen type shelf system, and a shelf and rod type shelf system.

It is an object of the present invention to provide mounting brackets which accommodate the addition of a convenient hang rod which converts the linen shelving system into a wardrobe shelf permitting uninterrupted hanging space.

It is an object of the present invention to incorporate curved shelving design that literally locks itself into the specially engineered mounting brackets for easy installation.

It is another object of the present invention to provide a means of converting the linen shelf to the hang rod shelf by simply mounting a hang rod adapter to the support brackets by utilizing a tongue and groove arrangement.

It is another object of the present invention to provide a shelf that removably and securely snaps into place via a friction fit within recesses or transverse slots formed into the top surface of the brackets so that no additional hardware is needed to hold the shelf in position or lock the hang rod into position.

In accordance with the present invention, the shelf and support assembly comprises a shelf having a downwardly projecting front lip portion and a plurality of projecting members such as transverse members or longitudinal frame members spaced apart and in alignment protruding from the bottom of the shelf. Moreover, at least one support bracket comprising an elongated shelf support member defines a rail having a generally flat top surface and a downwardly projecting front end portion including a plurality of recesses or transverse slots therein, including at least a front slot, rear slot, and at least one interior slot. The slots are positioned in alignment with and cooperatively engage selected transverse members of the shelf. The elongated shelf support member attaches to an elongated base member for mounting to a supporting structure such as a wall in a cantilevered fashion with conventional holding means such as screws.

More particularly, the shelf and support assembly of the preferred embodiment comprises a shelf including a plurality of spaced platform members and a plurality of spaced frame members fixedly connected to the platform members so as to define a generally rectangular grid-like shelf. Each of the frame members extend generally normal to the platform members. The ventilated shelf of the preferred embodiment includes at least a first front frame member, a second interior frame member, a third interior frame member, a fourth interior frame member, and a fifth rear frame member.

The shelf and support bracket assembly of the preferred embodiment also includes a pair of generally triangular shaped support brackets including an elongated shelf support member having a lower rear end portion and a lower front end portion defining a rail having a generally flat top surface curved downward on each end further defining a curved front end portion and a curved rear end portion. The rail is adapted for supporting the shelf which is secured thereto by a friction fit wherein projections such as tabs or transverse members extending from the bottom or distal ends of the shelves are snapped into a plurality of recesses or transverse slots within the top surface of the rail. Furthermore, the first front slot is cooperatively engaged with the first front frame member, a second interior slot cooperatively engages the second frame member, a third interior slot cooperatively engages the third central frame member, the fourth frame member rests upon the frame surface, and a fifth rear slot holds the fifth rear frame member. The support bracket also includes a vertical leg base member having a back portion, a lower end portion, and an upper end portion connecting to the lower rear end portion of the elongated shelf support member; a brace leg member interconnecting the lower front end portion of the elongated shelf support member with the lower end portion of the vertical leg member; and an elongated base member attached to the back portion of the vertical leg member and the lower end portion of the brace leg member, wherein the elongated base member has a generally planar rear surface adaptable for mounting the support brackets to a supporting structure such as a wall in a cantilevered fashion wherein the elongated shelf support member and the brace leg member extend outwardly perpendicular from the elongated base member. Furthermore, the support bracket can be mounted to the wall my conventional means of attachment such as by gluing, welding, fasteners (screws, nails, or brackets), or a tongue and groove arrangement.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

The shelf and support assembly 10 of the present invention utilizes a unique curved-front, wall mounted, ventilated shelf in combination with one type of bracket, and an optional hang rod assembly to make shelving systems for linen type shelf systems and wardrobe shelf systems.

Figure 1:
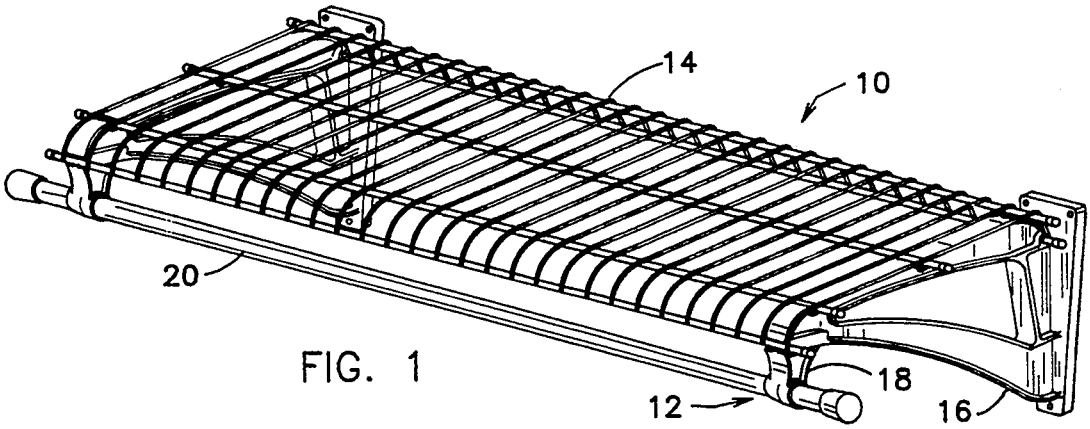
FIG. 1 is a perspective view of the shelf and support assembly of the present invention showing a ventilated shelf removably mounted to a support bracket and the optional hang rod assembly incorporated therewith.
Figure 2:
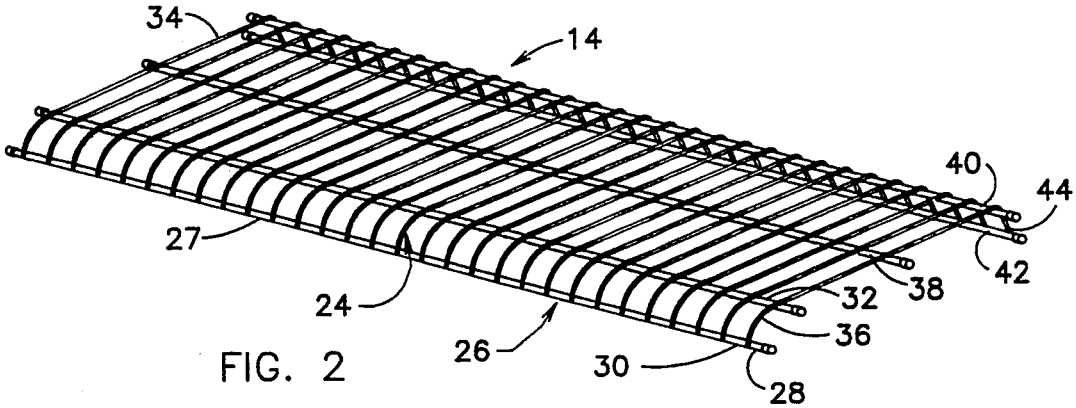
FIG. 2 is a perspective view of the shelf and support bracket assembly showing the ventilated shelf of FIG. 1 having the curved front lip and angled straight rear lip.
Figure 3:
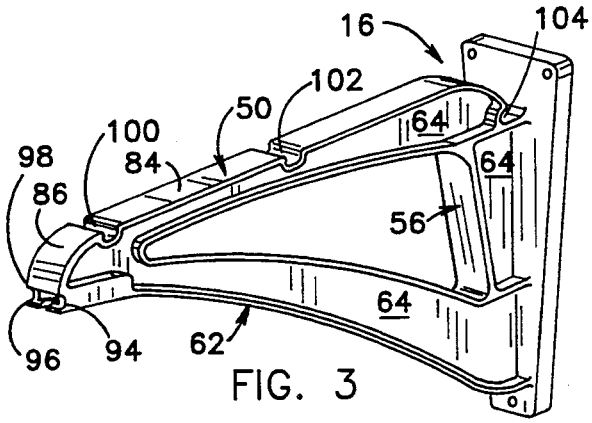
FIG. 3 is a perspective view of the support bracket of the present invention.
Figure 4:
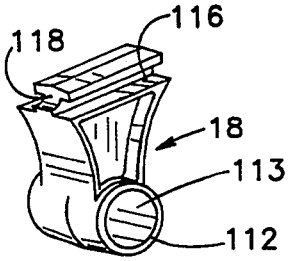
FIG. 4 is a perspective view of the hang rod adapter of the present invention.
Figure 5:
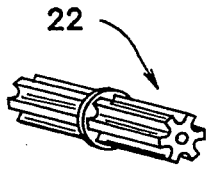
FIG. 5 is a perspective view of the connector for joining together two hang rod sections.
Figure 6:
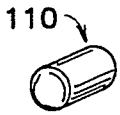
FIG. 6 is a shelf end cap to cover the exposed distal end of the frame members extending outward from the shelf.

The shelf and support assembly 10 of the present invention is shown in FIG. 1 including the optional hang rod assembly 12. The shelf and support assembly 10 of the preferred embodiment as illustrated in FIG. 1 is comprised of a ventilated shelf 14 as shown in FIG. 2, a support bracket 16 as shown in FIG. 3, a hang rod adapter 18 as shown in FIG. 4, a hang rod 20 as shown in FIG. 1, a connector 22 as shown in FIG. 5, and a shelf end cap 110 as shown in FIG. 6. The components of the shelf and bracket assembly 10 can be fabricated from wood, fiberglass, plastic, metal, or plastic coated metal.

As shown in FIGS. 1 and 2, the shelf 14 of the preferred embodiment is a wall mounted ventilated shelf 14 comprised of a plurality of shelf platform members 24 formed from "12 gauge", plastic, metal, and/or plastic coated metal stringers spaced apart and parallel to one another. The shelf platform members 24 are attached to and supported by a plurality of shelf frame members 26 formed from "4 gauge" support plastic, metal, and/or plastic coated metal rods to form the grid-like ventilated shelf 14. The shelf platform members 24 are fastened to the shelf frame members 26 by welding, gluing, brazing, or heat bonding or with mechanical fasteners. The distal ends 28 of the shelf frame members 26 extend beyond the outermost shelf platform members 24 in the preferred embodiment; however, the shelf may have shelf frame members 26 with the distal ends thereof stopping flush with the shelf platform members 24. An alternate embodiment of the shelf 14 of the present invention utilizes a solid shelf or shelf having apertures therein comprising plastic and/or metal fabricated having a plurality of shelf frame distal end members 28 for cooperative engagement with the brackets 16 of the present invention. Moreover, it is contemplated that an alternate embodiment of the present invention may utilize shelves 14 which are ventilated or have a solid surface with a plurality of tabs, transverse members, or other protrusions projecting from the bottom surface of the shelf 14 for cooperative engagement with holding means incorporated within the support bracket 16.

Figure 7:
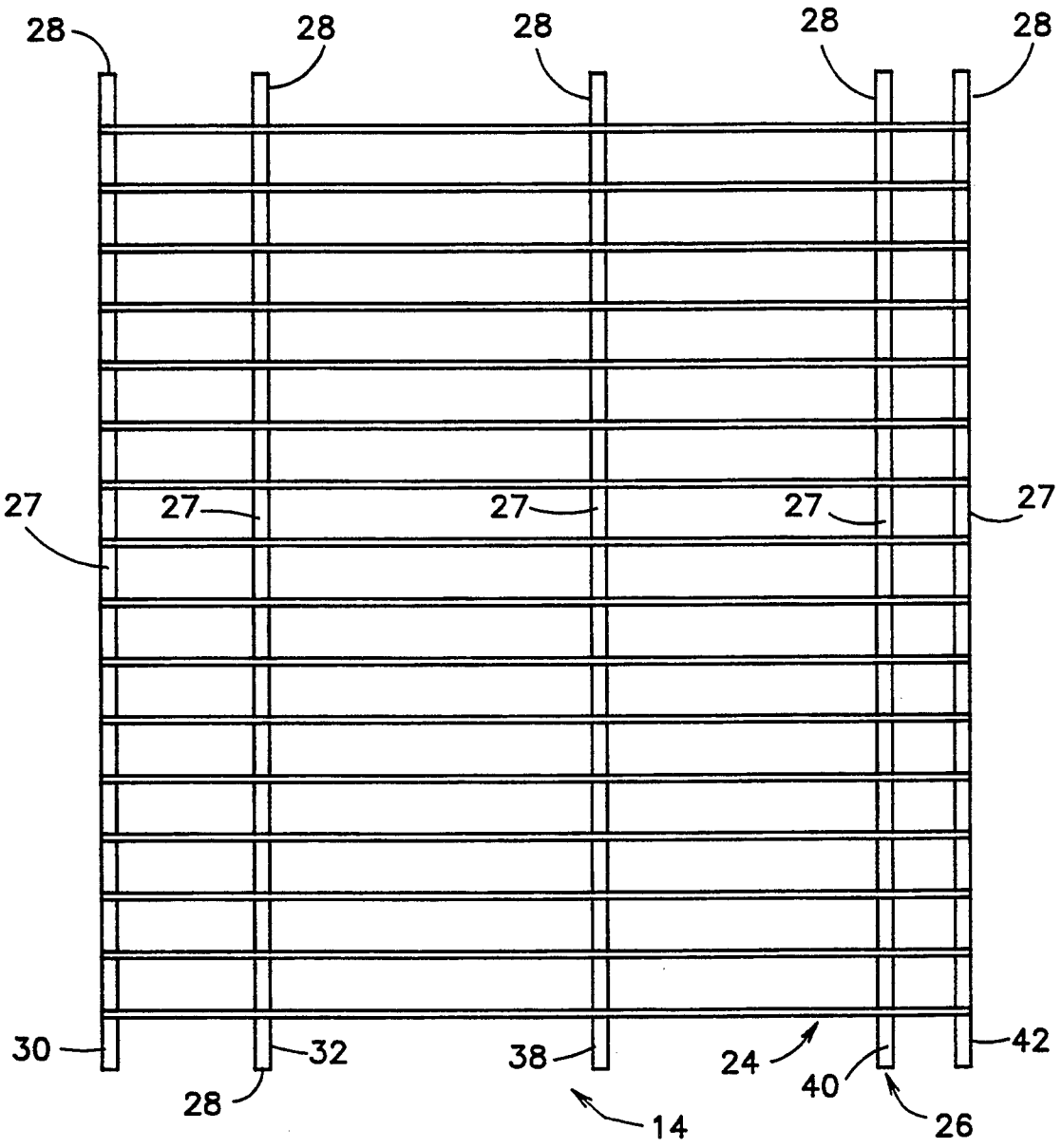
FIG. 7 is a top view of the ventilated shelf of the present invention.
Figure 8:
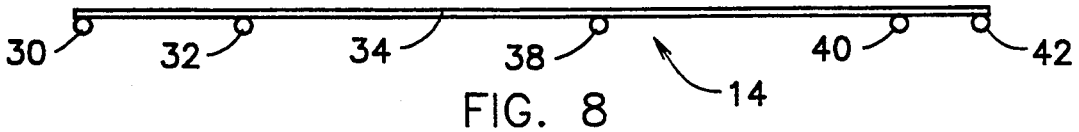
FIG. 8 is a side view of the ventilated shelf of the present invention before forming a curved front lip and straight rear lip.
Figure 9:
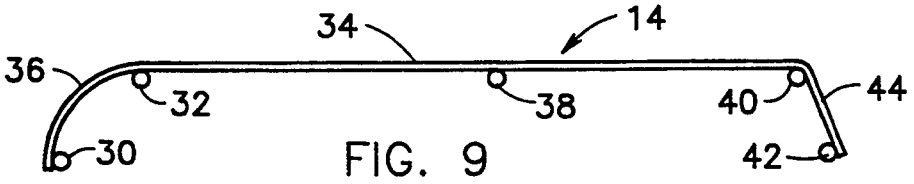
FIG. 9 is a side view of the ventilated shelf of the present invention after bending the shelf platform members forming a curved front lip shelf and angled straight rear lip.

As shown in FIGS. 7–9, the ventilated wire shelf 14 of the preferred embodiment includes a first outer, front shelf frame member 30 which extends normal to the shelf platform members 24 and joins with the distal ends of each of the shelf platform members 24 to form the front edge of the shelf 14. A second inner shelf frame member 32 is joined to the shelf platform members 24 and is parallel to the first shelf frame member 30. The portion of the shelf platform members 24 extending from the second frame member 32 to the first frame member 30 is curved downward to form a front curved shelf lip 36 as best shown in FIGS. 1, 2, and 9; however, it is contemplated a straight shelf 14 could be used with the support brackets 16 of the present invention. As shown in FIGS. 2 and 9, the second inner shelf frame member 32 forms the front end of the planar portion 34 of the shelf 14. A third inner shelf frame member 38 is joined to the shelf platform members 24 and extends along the longitudinal axis of the shelf 14 spaced apart from and parallel to the second frame member 32. A fourth inner shelf frame member 40 is joined to the shelf platform members 24. The distal ends of the shelf platform members 24 are joined to a fifth rear shelf frame member 42. The portion of the shelf platform members 24 extending from the fourth frame member 40 to the rear shelf frame member 42 is angled downwardly below the horizontal plane of the shelf surface, being bent downwardly at an angle around the fourth shelf frame member 40 to form an angled rear shelf portion defining an angled straight rear lip 44 as shown in FIGS. 1 and 9. The fourth frame member 40 forms the rear end of the planar portion 34 of the shelf 14.

FIG. 3 shows the shelf support member or support bracket 16 of the preferred embodiment for mounting the shelves 14 in cantilevered fashion on a single wall. Each of the support brackets 16 are identical and may be used as end support brackets 16 or intermediate support brackets 16 depending upon the length of the shelf 14. More particularly, as shown in FIGS. 10–14 show each of the support brackets 16 comprise a generally triangular shaped structure comprising an elongated shelf support member 50 oriented in the horizontal plane having a lower rear end portion 52 being connected to the upper end portion 54 of a vertical leg base member 56, wherein the elongated shelf support member 50 has a front end portion 58 connected to the lower end portion 60 of the vertical leg base member 56 by a brace leg member 62 interconnecting the elongated shelf support member 50 and the vertical leg base member 56.

As shown in the preferred embodiment in FIG. 3, the shelf support member 50, vertical leg member 56, and brace leg member 62 are provided with inwardly extending U-shaped channels 64 on opposite sides thereof which are adapted to provide structural strength to the bracket 16, minimize weight, and provide a uniform decorative finish. As shown in the preferred embodiment, the back portion 68 of the vertical leg member 56, and one distal end 70 of the brace leg member 62 are integrally formed or attached to an elongated base member 72 which supports the bracket 16. However, it is contemplated that the support bracket 16 may be fastened to an associated side wall by a conventional fastener (not shown) which passes through a plurality of apertures 66 extending through the U-shaped channels 64.

Figure 12:
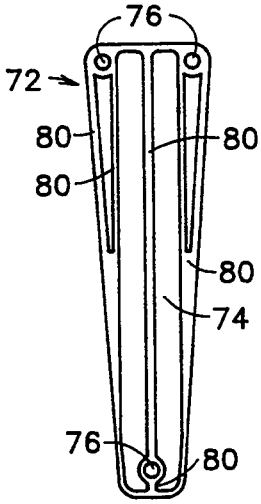
FIG. 12 is a rear plan view showing the support bracket of the present invention.

The elongated base member 72 includes a generally planar rear surface 74 for juxtaposition to an associated vertical wall or other supporting structure. As shown in FIG. 12, the rear surface 74 of the base member 72 includes three apertures 76 to accommodate a holding means such as screws (not shown) for attachment to a vertical support structure. Furthermore, the rear surface is formed having reinforcement ribs 80 around the apertures 76, through the central portion and around the outer edges of the base member 72 to provide additional structural strength to the base member 72, minimize weight, for added rigidity at the fastening points, and to prevent compression of the support bracket base member 72 during fastening. The elongated shelf support member 50, vertical leg brace member 56, and brace leg member 62 of the preferred embodiment are integrally formed with and extend outwardly from the generally flat, tapered, elongated base member 72. The elongated shelf support member 50, vertical leg brace member 56, and brace leg member 62 may be formed integrally with the base member 72, as shown in FIG. 3, or formed separately therefrom and attachable to the base member 72 by gluing, welding, fasteners, or a tongue and groove arrangement (not shown).

Figure 13:
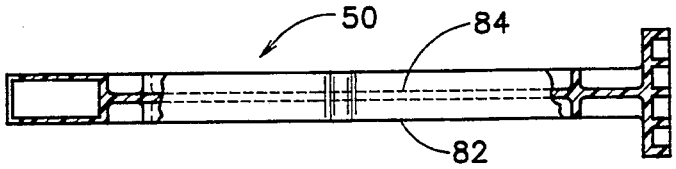
FIG. 13 is a top plan view showing the support bracket having the hang rod adapter mounted thereon.
Figure 14:
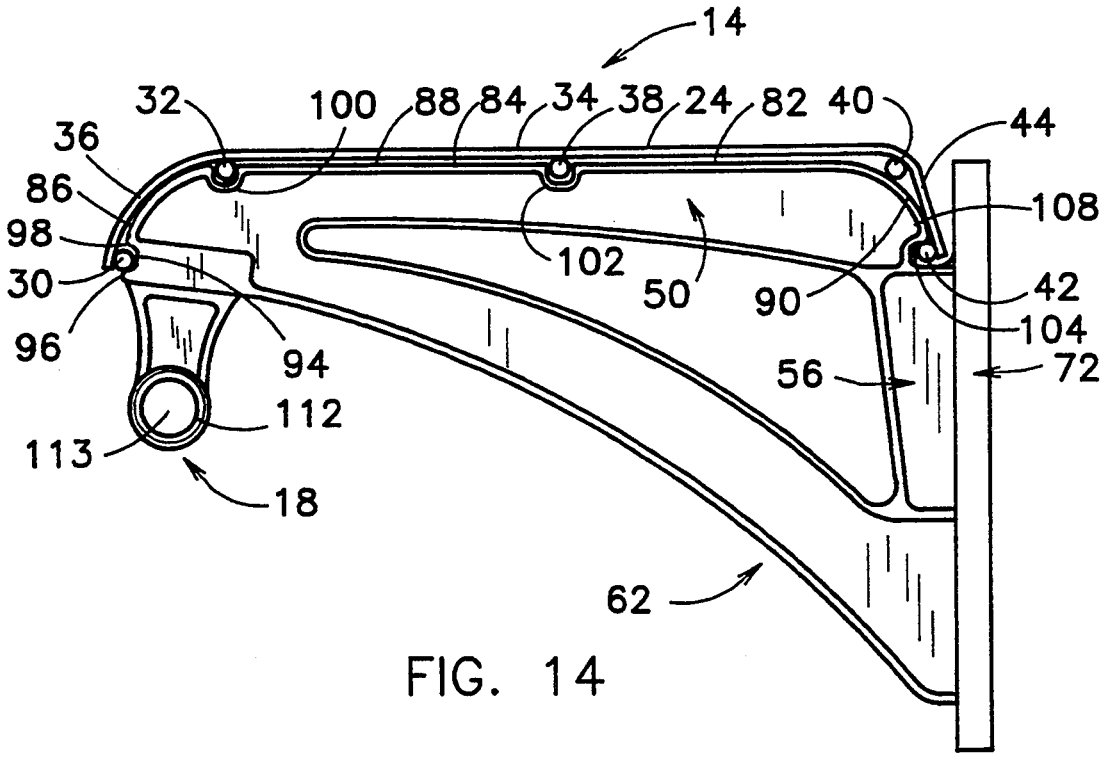
FIG. 14 is an elevated side view showing the shelf, and hang rod adapter in cooperative engagement with the support bracket of the present invention.

As illustrated in the top plan view of FIG. 13 and perspective views 1 and 3, the top of the elongated shelf support member 50 of the preferred embodiment is formed defining a longitudinal rail 82 having a generally flat platform surface 84, a downwardly projecting front end portion defining a front curved rail portion 86, and a rear curved rail portion 90 for supporting the shelf 14 and biasing the shelf frame members 26 holding and spreading the front frame member 30 and rear frame member 42 slightly apart under tension to secure the shelf 14. However, it is contemplated that the rear rail portion 90 could be angled to form a straight lip or extended in the horizontal plane in alignment with the shelf 14. As shown in the preferred embodiment, the platform surface 84 is formed having a plurality of transverse slots 94, 100, 102, 104 or recesses therein, sized and shaped for cooperative engagement with the shelf frame members 26 and recessed within the platform surface 84 to permit recessing of the body 27 and/or distal ends 28 of the shelf frame members 26 within the rail 82 at a depth which will permit the bottom of a flat shelf or the shelf platform members 24 of the ventilated shelf 14 to rest on or slightly above the platform surface 84 of the rail 82 as best shown in FIGS. 1 and 14. It is contemplated that the width of the brackets 16 may be varied with respect to the spacing of the shelf platform members 24 to allow the rail 82 to be disposed between adjacent shelf platform members 24. The platform surface 84 is adapted to receive a distal end 28 or body portion 27 of the shelf frame members 26 in a friction fit to prevent relative motion between the shelf 14 and the support brackets 16 when the shelf 14 is disposed thereon. The slots 94, 100, 102, 104 conceal the distal ends 28 of the shelf frame members 26 and provide a finished appearance to the shelf and support assembly 10. Furthermore, it is also contemplated that protrudes or tab members (not shown) may project downwardly from the shelf bottom to provide an optional means for cooperative engagement with the slots 94, 100, 102, 104 formed within the rails 82 to support and hold the shelf 14.

More particularly, as best shown in FIGS. 1, 3, and 14, the rail platform surface 84 has a first front transverse slot 94 formed at a selected depth within the front distal end 96 of the rail, recessed below the curved rail platform surface 86 forming a front rail lip 98 thereabove. The first front slot 94 is adapted for cooperative engagement with the first front support shelf frame member 30 to bias the shelf frame member 30 outward and downward with respect to the plane of the shelf 14. A second inner slot 100 is formed at a selected depth at the intersection of the front curved portion 86 of the rail 82 and the planar portion 88 of the rail 82 for cooperative engagement with a second inner shelf frame member 32, whereby the front curved shelf lip 36 and planar portion 34 of the shelf 14 are complementary with the curved and planar portions of the rail, 86 and 88 respectively. A third inner slot 102 is generally centrally located for cooperative engagement with a third shelf frame member 38. A fourth shelf frame member 40 is positioned at the junction of the planar portion 34 and angled rear shelf portion 44 of the shelf 14 is supported upon the surface of the rear curved portion 90 of the rail 82 at a selected position aligned to provide a level shelf 14. The fourth rear transverse slot 104 is formed at a selected depth within the distal end portion of the rail, recessed below the curved rail platform surface 90 forming a rear rail lip 108 thereabove. The fourth rear slot 104 is adapted for cooperative engagement with the fifth rear support shelf frame member 42 to bias and slightly spread apart the shelf frame member 42 in an outward and downward direction with respect to the first frame member 30 of the shelf 14.

A linen shelf assembly is formed by securely snapping the ventilated shelf 14 into place via a friction fit within the slots 94, 100, 102, 104 formed in the brackets 16 so that no additional hardware is needed to hold the shelf 14 in position.

Figure 10:
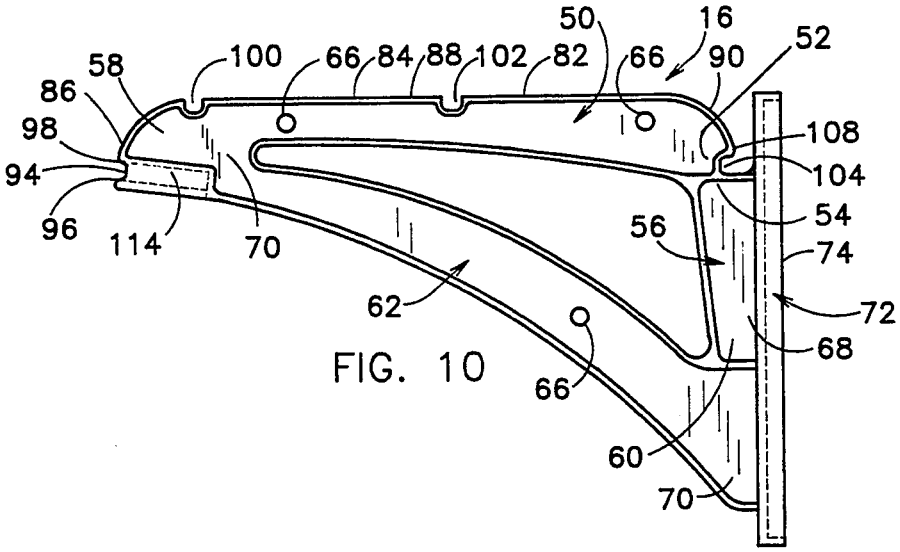
FIG. 10 is an elevated side view showing the support bracket of the present invention.
Figure 11:
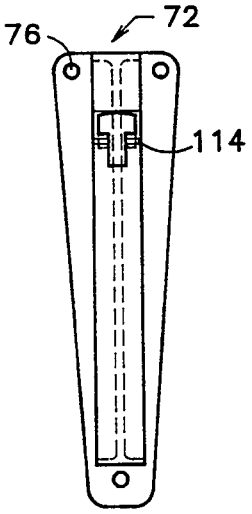
FIG. 11 is a front plan view showing the support bracket the present invention.

An alternate embodiment of the shelf and support bracket assembly 10 is shown as a shelf and rod type shelf system in FIGS. 1 and 14. Before snapping the shelf 14 within the slots 94, 100, 102, 104 of the brackets 16, a hang rod adapter 18, such as is shown in FIG. 4, is inserted into a recess forming a longitudinal groove or longitudinal slot 114 within the front end of the support bracket 16, more specifically, the front distal end 96 of the elongated member 50 beneath the curved shelf lip 36 as an extension of the central section of the first front transverse slot 94 as illustrated in FIGS. 3, 10, and 11.

Figure 15:
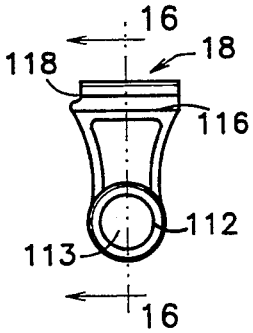
FIG. 15 is an elevated side view showing the hang rod adapter of the present invention.
Figure 16:
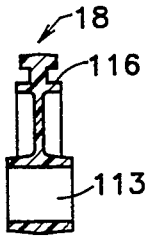
FIG. 16 is a cutaway front view showing a cross-sectional view of the hang rod adapter of the present invention along Section 16—16.

The hang rod adapter 18 is formed having a sleeve 112 having a cylindrical bore 113 therethrough, as shown in the elevated side view of FIG. 15, oriented normal to the support bracket 16. The hang rod adapter 18 includes a "T-shaped" base 116 extending from the end opposite the sleeve 112 and oriented at a right angle with respect to the sleeve 112. The front end of said "T-shaped" portions of said hang rod adapter forms an arcuate depression 118 for cooperative engagement with the front frame member 30. FIG. 16 is a cutaway front view showing a cross-sectional view of the hang rod adapter 18 of the present invention along Section 16—16. The "T-shaped" base 116 fits in cooperative engagement with the longitudinal groove 114 of the support bracket 16 in a tongue and groove arrangement as illustrated in FIG. 14.

The shelf and rod wardrobe shelf system 10 is constructed by simply placing the hang rod adapter 18 into the front grooved recess 114 in the front of each bracket 16 as shown in FIG. 14. A hang-rod 20 such as shown in FIG. 1, can then be slid through the sleeve 12 into the bore 113 of the hang rod adapter 18. The shelf frame members 26 of the shelf 14 are then snapped into place within the slots 92 of the bracket 16, whereby the first front shelf frame member 30 is positioned over the hang rod adapter 18 and snapped into place into slot 94 and biased by the front rail lip 98 thereby locking the adapter 18 into position within the "T-shaped" groove 114.

As shown in FIG. 5, a connector 22 may be used to connect or splice two hang rods 20 together to lengthen a hang rod 20 or join the hang rods 20 of adjoining shelf assemblies together. An end cap 110 such as is shown in FIG. 6 may be used to cover the distal ends 28 of the shelf frame members 26 to prevent damage to adjacent wall structures or the user from any portion of the ventilated shelf frame members 26 extending past the support brackets 16.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims.

I claim:

1. A shelf and support assembly, comprising:

a ventilated shelf having a shelf surface formed having a downwardly projecting front lip portion and having a plurality of transverse members protruding from the bottom of said shelf;

at least one support bracket comprising an elongated shelf support member defining a rail having a generally flat top surface and a downwardly projecting front end portion, said rail including a plurality of transverse slots including at least a first front slot and a second slot, said slots being positioned in alignment with and cooperatively engaging selected transverse members of said shelf, said elongated shelf support member attaching to an elongated base member for mounting to a supporting structure in a cantilevered fashion, said elongated base member having a rear surface, wherein the rear surface of the elongated base member includes at least one aperture therein in cooperative relationship with means for holding said elongated base member to said supporting structure.

2. The shelf and support assembly of claim 1, wherein said elongated shelf support member is formed integrally with said elongated base member.

3. The shelf and support assembly of claim 1, wherein said elongated shelf support member is formed having inwardly extending U-shaped channels on opposite sides thereof adapted for providing structural strength to said support bracket, minimize weight, and provide a uniform decorative finish.

4. The shelf and support assembly of claim 1, wherein said elongated base member is formed having a plurality of reinforcement ribs therein for providing additional structural strength, minimizing weight, adding rigidity at the fastening points, and preventing compression of said elongated base member during fastening to a supporting structure.

5. The shelf and support assembly of claim 1, where said elongated shelf support member further includes a plurality of apertures therethrough for attaching said support bracket to a vertical side wall.

6. The shelf and support assembly of claim 1, wherein said downwardly projecting front end portion of said rail forms a curving front end portion.

7. The shelf and support assembly of claim 1, said elongated shelf support member defining a rail having a generally flat top surface and a downwardly projecting rear end portion.

8. The shelf and support assembly of claim 1, wherein said downwardly projecting rear end portion of said rail forms a curving rear end portion.

9. The shelf and support assembly of claim 1, wherein a rear portion of said shelf is bent forming an angled rear shelf portion defining a straight rear lip.

10. The shelf and support assembly of claim 1, where said ventilated shelf includes a plurality of shelf platform members, said shelf platform members being perpendicular to said transverse members, wherein said support bracket is of a selected width to fit between said shelf platform members.

11. The shelf and support assembly of claim 1, wherein said support bracket includes a longitudinal groove extending from said downwardly projecting front end portion toward said elongated base member.

12. The shelf and support assembly of claim 1, including a hang rod adapter.

13. The shelf and support assembly of claim 1, including a means for removably mounting a hang rod adapter to the front ends of at least two elongated shelf support members.

14. The shelf and support assembly of claim 13, wherein said means for removably mounting said hang rod adapter comprises a tongue and groove assembly.

15. The shelf and support assembly of claim 14, wherein said groove is a longitudinal groove integrally formed within said support bracket.

16. The shelf and support assembly of claim 15, wherein said longitudinal groove is a coextension of the central section of said front transverse slot.

17. The shelf and support assembly of claim 16, wherein said plurality of transverse members includes a first transverse member, where said first transverse member fits in a cooperative relationship with said front transverse slot covering said longitudinal groove.

18. The shelf and support assembly of claim 12, said hang rod adapter comprising a sleeve at one end, said sleeve having a bore therethrough for sliding communication with a hang rod, and a base extending from the end opposite said sleeve being in cooperative engagement with said support bracket.

19. The shelf and support assembly of claim 18, wherein said base comprises a "T-shaped" member being oriented normal with respect to said sleeve.

20. The shelf and support assembly of claim 19, wherein said "T-shaped" member includes a front end portion, said front end portion having an arcuate depression for cooperative engagement with said first transverse member.

21. The shelf and support assembly of claim 12, including a hang rod supported by said hang rod adapter.

22. A shelf and support assembly, comprising:

a) a ventilated shelf comprising a plurality of spaced platform members and a plurality of spaced frame members fixedly connected to said platform members so as to define a generally rectangular grid-like shelf, each of said frame members extending generally normal to said platform members, said shelf comprising at least a first front frame member and a second frame member; and b) a pair of generally triangular shaped support brackets, each of said support brackets comprising:

i) an elongated shelf support member having a lower rear end portion and a lower front end portion, said elongated shelf member member defining a rail having a generally flat top surface curved downward on each end defining a curved front end portion and a curved rear end portion, said rail being adapted for supporting said shelf, said rail surface including at least first front transverse slot in cooperative communication with said first front frame member, and a second interior recess in cooperative communication with said second frame member;

ii) a vertical leg base member connecting to said elongated shelf support member;

iii) a brace leg member interconnecting said elongated shelf support member with said vertical leg member; and iv) an elongated base member attached to said vertical leg member and said brace leg member, said elongated base member having a generally planar rear surface adaptable for mounting said support brackets to a supporting structure in a cantilevered fashion, wherein said elongated shelf support member and said brace leg member extend outwardly from said elongated base member; and c) means for attaching said elongated base member to said supporting structure.

23. The shelf and support assembly of claim 22, wherein said elongated shelf support member is formed integrally with said elongated base member.

24. The shelf and support assembly of claim 22, wherein said elongated shelf support member, said vertical leg member, and said brace leg member are formed having inwardly extending U-shaped channels on opposite sides thereof adapted for providing structural strength to said support bracket, minimize weight, and provide a uniform decorative finish.

25. The shelf and support assembly of claim 22, wherein said generally planar rear surface of said elongated base member is formed having a plurality of reinforcement ribs extending around selected portions thereof providing additional structural strength, minimizing weight, adding rigidity at the fastening points, and preventing compression of said elongated base member during fastening to a supporting structure.

26. The shelf and support assembly of claim 22, wherein the rear surface of the elongated base member includes at least one aperture therein in cooperative relationship with a holding means for attachment to a vertical support structure.

27. The shelf and support assembly of claim 22, wherein said support bracket includes a plurality of apertures therethrough for attaching said support bracket to a vertical side wall.

28. The shelf and support assembly of claim 22, wherein said shelf platform members having a portion extending from said second frame member to said first frame member curving downward forming a front curved shelf lip extending around said front curved portion of said rail.

29. The shelf and support assembly of claim 22, where said plurality of spaced frame members further comprises a third frame member, a fourth frame member, and a fifth rear frame member; wherein a portion of said shelf platform members extending from said fourth frame member to said fifth rear frame member is formed angled downward around said fourth frame member forming an angled rear shelf portion defining a straight rear lip.

30. The shelf and support assembly of claim 22, wherein said support brackets are of a selected width to fit between said shelf platform members.

31. The shelf and support assembly of claim 22, wherein said support brackets include a longitudinal groove extending from said first transverse slot of said elongated shelf support member toward said brace leg member.

32. The shelf and support assembly of claim 22, wherein said support bracket includes means for holding a hang rod adapter removably mounted interposed within the front end portion of said elongated shelf support member.

33. The shelf and support assembly of claim 32, wherein said means for holding a hang rod adapter comprises a longitudinal groove.

34. The shelf and support assembly of claim 33, wherein said longitudinal groove is a coextension of the central section of said first front transverse slot.

35. The shelf and support assembly of claim 34, wherein said first front frame member fits in a cooperative relationship with said first front transverse slot covering said longitudinal groove and biasing said hang rod adapter inwardly.

36. The shelf and support assembly of claim 32, said hang rod adapter comprising a sleeve at one end, said sleeve having a bore therethrough for sliding communication with a hang rod and a "T-shaped" base extending from the end opposite said sleeve, said "T-shaped" base being oriented normal with respect to said sleeve.

37. The shelf and support assembly of claim 36, wherein the front end of said "T-shaped" portions of said hang rod adapter forms an arcuate depression for cooperative engagement with said first front frame member.

38. The shelf and support assembly of claim 32, including a hang rod supported by said hang rod adapter.

39. A shelf and support assembly, comprising:

a) a ventilated shelf comprising a plurality of spaced platform members and a plurality of spaced frame members fixedly connected to said platform members so as to define a generally rectangular grid-like shelf, each of said frame members extending generally normal to said platform members, said shelf comprising at least a first front frame member, a second interior frame member, a third interior frame member, a fourth interior frame member, and a fifth rear frame member; and b) a pair of generally triangular shaped support brackets, each of said support brackets comprising:

i) an elongated shelf support member having a lower rear end portion and a lower front end portion, said elongated shelf member defining a rail having a generally flat top surface curved downward on each end defining a curved front end portion and a curved rear end portion, said rail adapted for supporting said shelf, said rail surface including a first front transverse slot in cooperatively engaging said first front frame member, a second interior transverse slot cooperatively engaging said second frame member, a third interior transverse slot cooperatively engaging said third central frame member, and a fifth rear transverse slot cooperatively engaging said fifth rear frame member and biasing said fifth rear frame member outwardly from said first front frame member;

ii) a vertical leg base member having a back portion, a lower end portion, and an upper end portion connecting to said lower rear end portion of said elongated shelf support member;

iii) a brace leg member interconnecting said lower front end portion of said elongated shelf support member with said lower end portion of said vertical leg member; and iv) an elongated base member attached to said back portion of said vertical leg member and said lower end portion of said brace leg member, said elongated base member having a generally planar rear surface adaptable for mounting for mounting said support brackets to a supporting structure in a cantilevered fashion, wherein said elongated shelf support member and said brace leg member extends outwardly perpendicular from said elongated base member; and c) means for attaching said elongated base member to said supporting structure.

* * * * *

UNITED STATES PATENT AND TRADEMARK OFFICE

CERTIFICATE OF CORRECTION

PATENT NO. : 5,351,842

DATED : Oct. 4, 1994

INVENTOR(S) : Lee E. Remmers, Ocala, Fla.

It is certified that error appears in the above-indentified patent and that said Letters Patent is hereby corrected as shown below:

In Column 10, Line 28, after shelf and before member delete "member" insert --support--

Signed and Sealed this

Second Day of May, 1995

Bruce Lehman

*Attest:*

BRUCE LEHMAN

*Attesting Officer*

*Commissioner of Patents and Trademarks*